United States Patent [19]

Terrell et al.

[11] Patent Number: 4,620,591

[45] Date of Patent: Nov. 4, 1986

[54] CHEMICAL CUTTING APPARATUS HAVING SELECTIVE PRESSURE BLEED-OFF

[75] Inventors: Jamie B. Terrell; Donna K. Pratt, both of Fort Worth, Tex.

[73] Assignee: Gearhart Industries, Inc., Fort Worth, Tex.

[21] Appl. No.: 722,506

[22] Filed: Apr. 12, 1985

[51] Int. Cl.[4] ..... E21B 29/02

[52] U.S. Cl. ..... 166/63; 166/55; 166/212

[58] Field of Search ..... 166/63, 299, 55, 55.1, 166/55.2, 55.6–55.8, 212, 217, 207, 208

[56] References Cited

U.S. PATENT DOCUMENTS

| | | | |
|---|---|---|---|
| 4,250,960 | 2/1981 | Chammas | 166/55 |
| 4,315,797 | 2/1982 | Peppers | 166/55.2 X |
| 4,415,029 | 11/1983 | Pratt et al. | 166/63 X |
| 4,494,601 | 1/1985 | Pratt et al. | 166/212 X |

*Primary Examiner*—Stephen J. Novosad
*Assistant Examiner*—Thuy M. Bui
*Attorney, Agent, or Firm*—Hubbard, Thurman, Turner & Tucker

[57] ABSTRACT

A chemical cutting apparatus for use within a well bore is disclosed. The apparatus of the present invention includes a tubular casing adapted to be lowered into a well bore. The tubular casing contains an internal chamber containing a chemical cutting fluid. A remotely operated explosive charge pressurizes the chamber of chemical cutting fluid and simultaneously forces chemical cutting fluid out through a discharge passage and erects a plurality of slips which anchor the tubular casing within the well bore. After a cutting operation has taken place, pressure buildup within the tubular casing which occurs as a result of a clogged discharge passage may be vented or bled off by the selective opening of a second discharge passage, thus preventing undesired engagement of the anchor slips during removal of the apparatus. In a preferred embodiment of the present invention, an interlock is provided which prevents the opening of the second discharge passage prior to ignition of the explosive charge.

15 Claims, 7 Drawing Figures

CHEMICAL CUTTING APPARATUS HAVING SELECTIVE PRESSURE BLEED-OFF

BACKGROUND OF THE INVENTION

This invention relates in general to apparatus for chemically cutting objects within a well bore and in particular to apparatus for chemically cutting objects within a well bore which include means for selectively venting the pressure within the tool while the tool is still within the well bore.

Chemical cutting devices or tools are well known within the prior art and are frequently utilized to cut, sever, perforate or slot an object within a well bore. The objects referred to above may include metal pipe, well bore casing, earth formations or foreign objects such as lost tools which may be found within the well bore.

Such known devices are typically tubular casings which enclose a chamber of a chemical cutting fluid which is extremely active chemically and which reacts violently when brought into contact with most oxidizable substances. Examples of such cutting fluids include fluorine and the halogen fluorides including such compounds as chlorine trifluoride, chlorine monofluoride, bromine trifluoride, bromine pentafluoride, iodine pentafluoride and iodine hextafluoride in mixtures thereof.

Generally stated, chemical cutting fluids of a character such as are described above are introduced into a well bore in a confined chamber within a tubular casing and the fluid is caused to discharge from the tubular casing in one or more high velocity streams or jets by applying to the chamber a suitable pressurizing agent. Pressurizing agents known in the prior art include hydraulic or pneumatic fluids. Pneumatic fluids may be gases generated by ignition of one of the various types of relatively slow burning gunpowders or other deflagrating types of explosives including black powder, rocket propellant powders or the like. By appropriate selection of an explosive and by means of preparation procedures well known to those skilled in the art of such explosives, the ignition and burning rates of such explosives may be effectively controlled to generate gases at any desired rate and volume suitable for applying the desired pressurizing forces to the confined chamber of cutting fluid.

Another well known feature of these chemical cutting tools includes the utilization of pressure operated slips or anchors which are utilized to retain the tool in a selected position during operation of the chemical cutting fluid. These devices typically operate in reponse to pressure within the tubular casing caused by actuation of an explosive charge or other pressurizing medium and erect outward from the periphery of the tubular casing to lock the tool in position during operation. A problem which has been noted in known chemical tools involves the frequent occurrence wherein the discharge passage becomes clogged after a cutting operation has occurred. When the tool is withdrawn, the pressure within the tool cannot discharge and the hydrostatic pressure in the well bore becomes substantially lower than the internal pressure of the tool. The slips or anchors which are utilized to maintain the tool in position respond to this pressure by erecting and anchoring the tool in place, rendering the tool difficult if not impossible to remove without damage to the tool or the casing. Thus, it should be apparent to those ordinarily skilled in the art that a need has existed for a chemical cutting tool which includes a means for selectively venting or bleeding off built up pressure within a tool which occurs as a result of a clogged discharge passage.

SUMMARY OF THE INVENTION

It is therefore one object of the present invention to provide an improved chemical cutting apparatus for utilization within a well bore.

It is another object of the present invention to provide an improved chemical cutting apparatus for utilization within a well bore which permits pressure within the tool to be selectively vented.

It is still another object of the present invention to provide an improved chemical cutting tool for utilization within a well bore which permits pressure within the tool to be selectively vented only after the chemical cutting fluid has been pressurized and the cutting operation has occurred.

The foregoing objects are achieved as is now described. The chemical cutting apparatus of the present invention includes a tubular casing adapted to be lowered into a well bore. The tubular casing contains an internal chamber containing a chemical cutting fluid. A remotely operated explosive charge pressurizes the chamber of chemical cutting fluid and simultaneously forces chemical cutting fluid out through a discharge passage and erects a plurality of slips which anchor the tubular casing within the well bore. After a cutting operation has taken place, pressure buildup within the tubular casing which occurs as a result of a clogged discharge passage may be vented or bled off by the selective opening of a second discharge passage, thus preventing undesired engagement of the anchor slips during removal of the apparatus. In a preferred embodiment of the present invention, an interlock is provided which prevents the opening of the second discharge passage prior to ignition of the explosive charge.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1A:
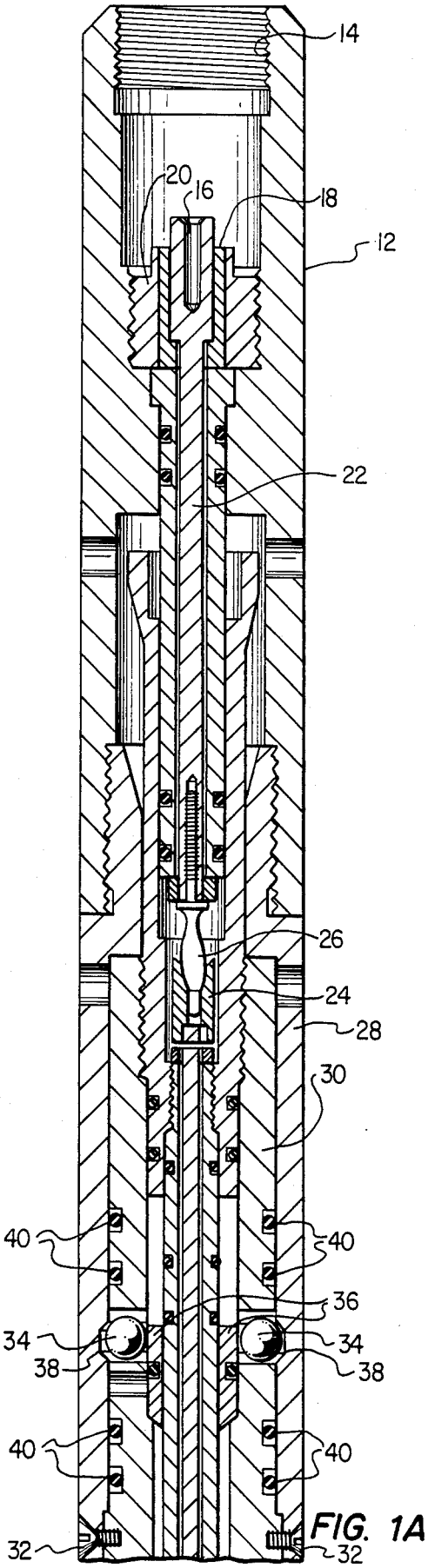
FIGS. 1A–1E, when placed end to end, form a sectional view of the novel chemical cutting apparatus of the present invention.

With reference now to the figures and in particular with reference to FIGS. 1A–1E, there is depicted a sectional view of novel chemical cutting apparatus 10 of the present invention. As can be seen in FIG. 1A, chemical cutting apparatus includes a contact subassembly 12 which includes a threaded section 14 suitable for coupling line (not shown). Contact subassembly 12 serves to enclose electrical contact 16 which is mounted within contact insulator 18 and anchored in place by contact retainer 20.

The electrical signals necessary to electrically operate apparatus 10 are coupled through feed through rod 22 to bottom contact 24 by means of banana plug 26. Those skilled in the art will appreciate that many other forms of electrical contact may be utilized so long as such techniques are not adversely affected by the environment in which these tools must operate. As can be seen, the upper portion of contact subassembly 12 is threaded into a lower portion 28 and elastomeric sealing devices, such as O-rings, are utilized throughout apparatus 10 to maintain a seal between adjacent surfaces.

Lower portion 28 of contact subassembly 12 is slidably mounted onto bleed-off subassembly 30 and is maintained in place by means of shear screws 32, which are designed to shear under a preselected load. Another important factor in the novel design of chemical cutting apparatus 10 of the present invention may be seen in the utilization of steel balls 34, which rest between ball retaining piston 36 and an annular groove 38 which is provided on the inner surface of lower portion 28. Thus, despite any malfunction or even the absence of shear screws 32, lower portion 28 of contact subassembly 12 will be maintained in a fixed relationship with bleed-off subassembly 30 by the locking action of steel balls 34. Again, those skilled in the art will appreciate that multiple O-ring seals 40 may be utilized to hermetically seal the gap between bottom portion 28 of contact subassembly 12 and bleed-off subassembly 30.

Figure 1B:
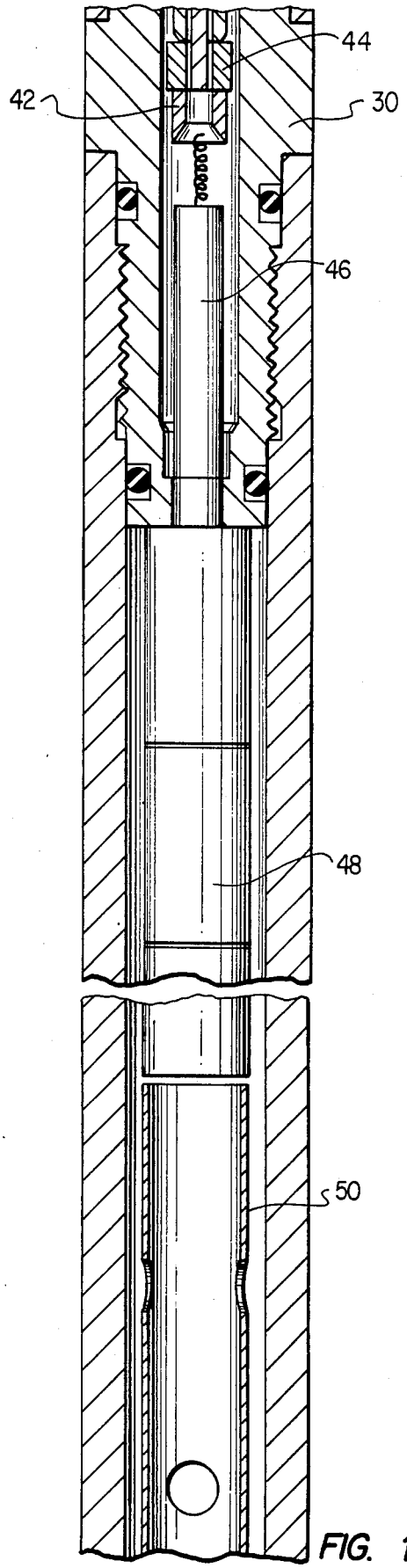

Referring now to FIG. 1B, it can be seen that the electrical signals necessary to operate apparatus 10 are coupled to fuse contact 42 which is mounted in fuse contact insulator 44. Fuse contact 42 is then electrically coupled to fuse 46 which serves to ignite propellant 48. Those skilled in this art will appreciate that many types of propellant charge may be utilized to provide the pneumatic pressure necessary to operate apparatus 10. Included among these propellants are any number of explosive materials which may be handled safely and which may be electrically ignited. Preferably, a propellant spacer 50 is utilized to smooth out the initial impact of the propellant within apparatus 10.

Figure 1C:
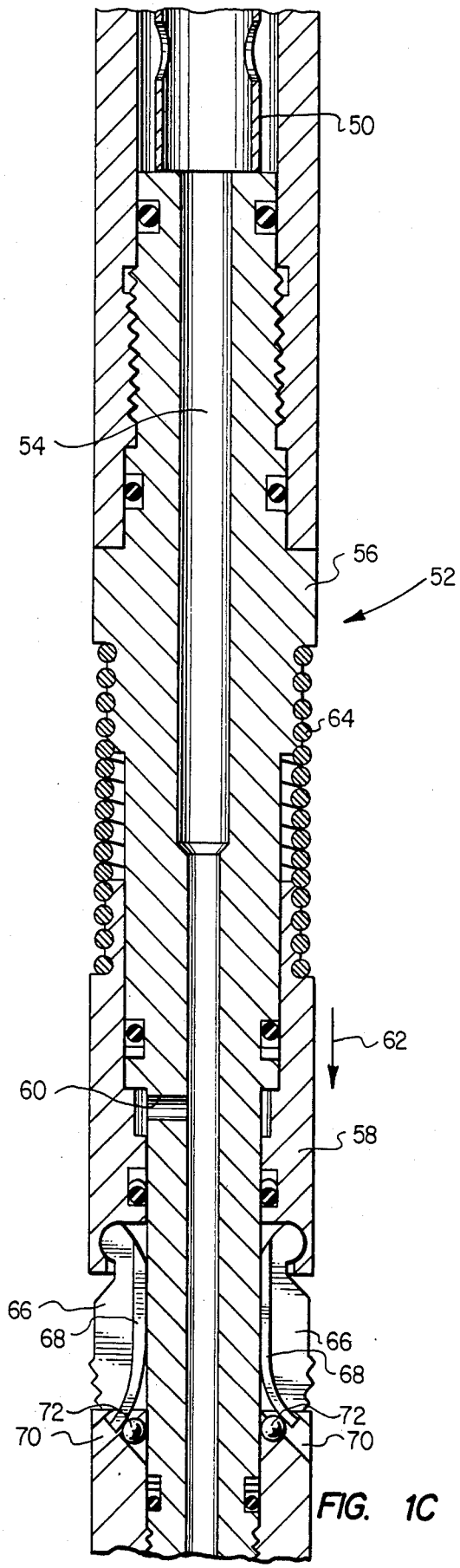

With reference now to FIG. 1C, the next subassembly in apparatus 10, moving progressively downward as apparatus 10 is normally disposed within a borehole, is slip subassembly 52. Slip subassembly 52 is an important design feature of chemical cutting apparatus 10 and serves to provide a reliable method of anchoring apparatus 10 within a borehole during a cutting operation. As the fluid pressure within apparatus 10 increases as a result of the ignition of propellant 48 and the action of the chemical cutting fluid, the pressure within apparatus 10 is coupled through longitudinal passage of 54 of slip shaft 56. The fluid pressure present is then exerted on the inner surface of top slip subassembly 58, through aperture 60, forcing top slip subassembly 58 downward, in the direction of arrow 62.

In its pre-ignition state, top slip subassembly 58 is retained in the depicted position by means of spring 64, which is forced to expand with movement of top slip subassembly 58.

As can be seen in the figures, spring 64 is threaded onto slip shaft 56 and onto top slip subassembly 58. In this manner a much larger spring may be utilized without greatly enlarging the diameter of the tool. Pivotally mounted at the lower end of top slip subassembly 58 are a plurality of slips 66, each of which includes a raised ridge 68. Each ridge 68 is mounted through annular grooves 70 which, in cooperation with ball bearing 72 serve to splay slip 66 outward in response to a downward movement of top slip subassembly 58. By pressing ball bearings 72 into top slip subassembly 58 the friction between each slip 66 and annular groove 70 is minimized. Of course, as the pressure within longitudinal passage 54 diminishes, top slip subassembly 58 will be urged back into the depicted position by spring 64, returning slips 66 to their retracted position.

Figure 1D:
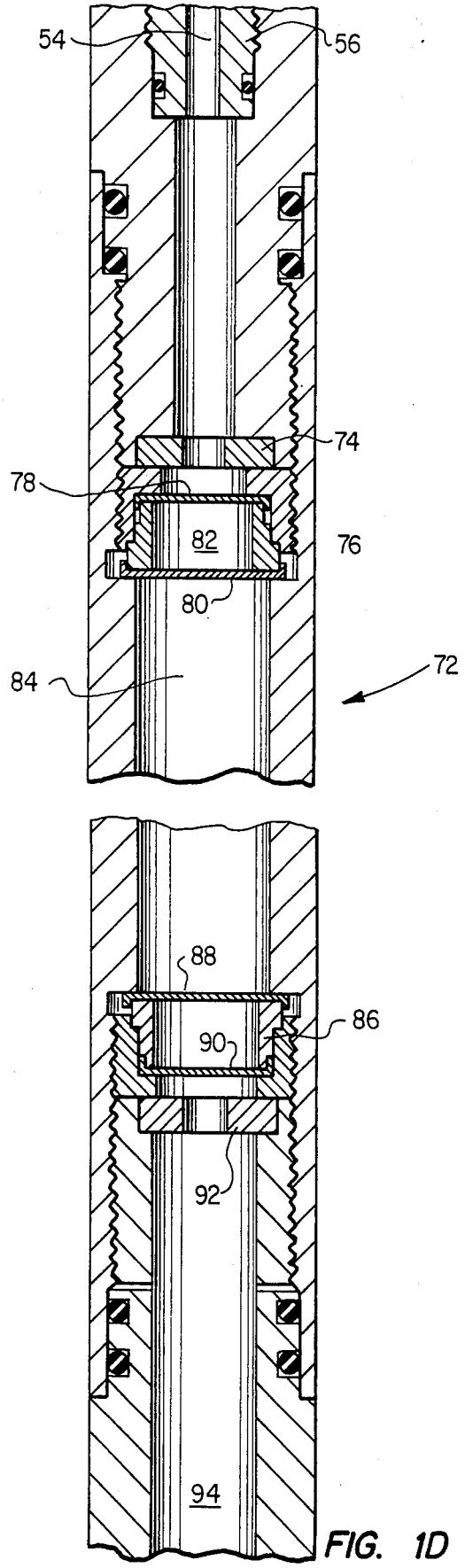

Referring now to FIG. 1D, chemical subassembly 72 is depicted. As may be seen, longitudinal passage 54 couples propellant 48 and the pressure generated thereby into chemical subassembly 72 through internal washer 74 to the upper surface of dual diaphragm seal 76. Dual diaphragm seal 76 includes an upper rupturable membrane 78 and a lower rupturable membrane 80 which are separated by a dead air space 82. It is known from prior art tools that the utilization of this dual diaphragm seal technique serves to muffle the effect of propellant 48 and results in a smooth flow of chemical cutting agent.

Chamber 84 beneath dual diaphragm seal 76 serves to retain a suitable chemical cutting fluid or gas, as discussed above. A second dual diaphragm seal 86 which includes rupturable membranes 88 and 90 serves to enclose the bottom of chamber 84, or, in an alternate embodiment of the present invention wherein multiple chambers 84 are utilized, dual diaphragm seal 76 will seal the upper end of the uppermost chemical cutting fluid chamber 84 and dual diaphragm seal 86 will serve to seal the lower end of the lowermost chemical cutting fluid chamber 84. After propellant 48 has been ignited and pressurizes chamber 84 after rupturing the associated dual diaphragm seals, the highly incendiary chemical cutting fluid contained therein is forced downward through washer 92 into longitudinal passage 94.

Figure 1E:
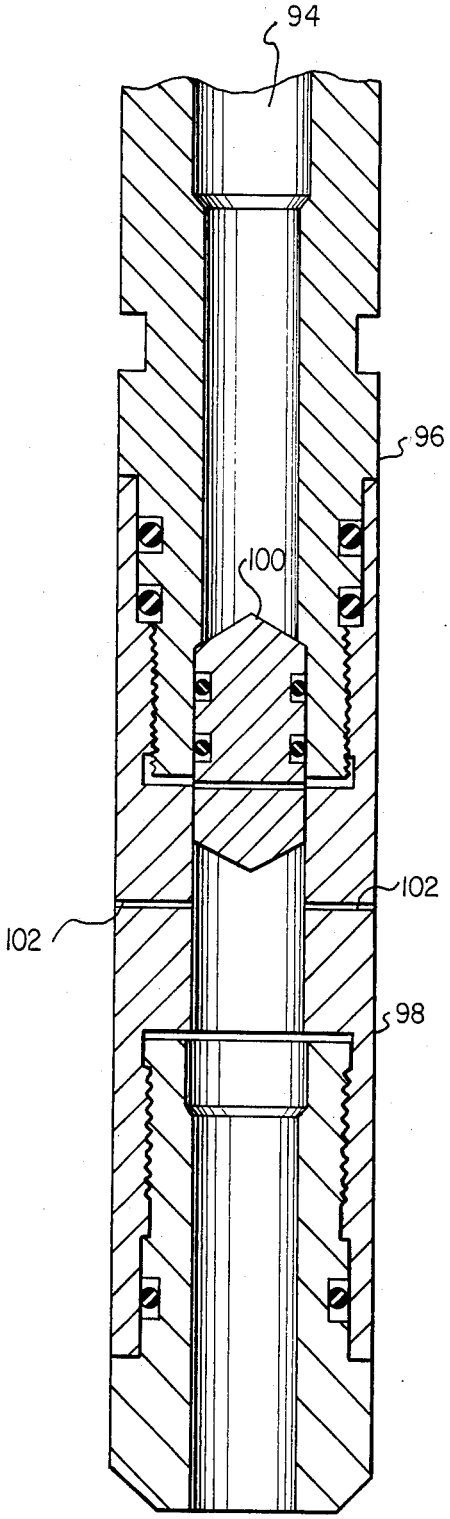

With reference now to FIG. 1E, the igniter subassembly 96 and head subassembly 98 are depicted. As pressurized chemical cutting fluid is forced downward in longitudinal passage 94, it encounters piston plug 100 which is forced downward until it seats in head subassembly 98. At that point, the pressurized cutting fluid is forced outward into the well bore through discharge passage 102, oxidizing most materials present at that point.

Figure 2:
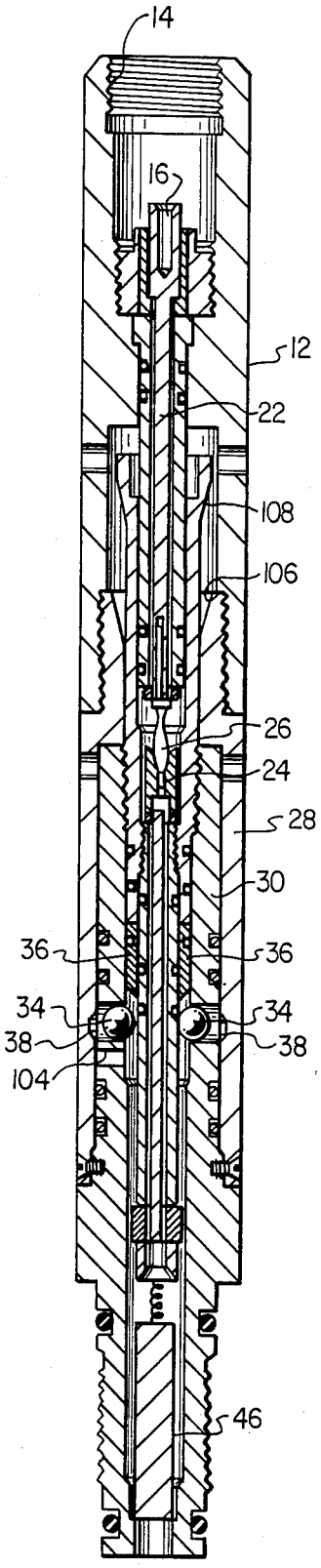
FIG. 2 depicts a sectional view of the bleed-off assembly of the novel chemical cutting apparatus of the present invention after the apparatus has been operated.
Figure 3:
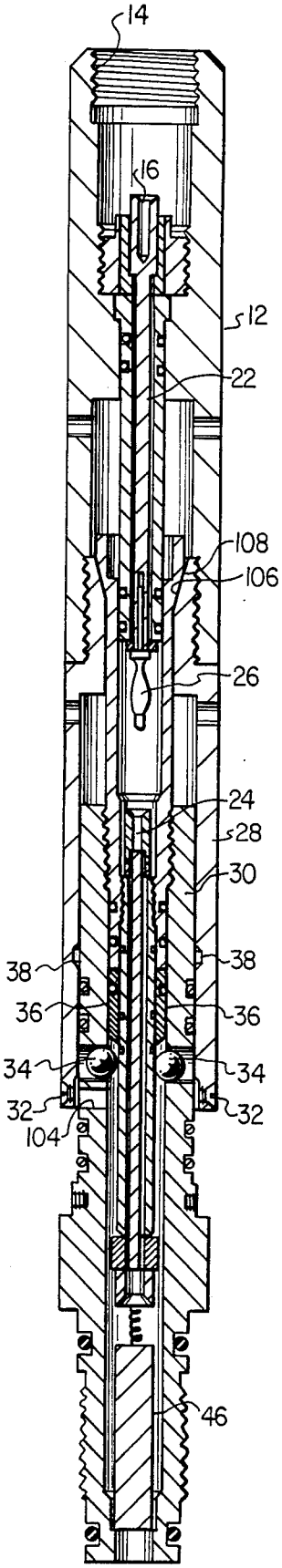
FIG. 3 depicts a sectional view of the bleed-off assembly of the novel chemical cutting apparatus of the present invention in the bleed-off position.

With reference now to FIG. 1A, FIG. 2 and FIG. 3, there are depicted three figures which will serve to illustrate the novel selective bleed-off apparatus of the present invention. As discussed above, with respect to FIG. 1A, steel balls 34 serve to anchor the lower portion 28 of contact subassembly 12 to the bleed-off subassembly 30 while maintained in annular groove 38 by ball retaining piston 36. However, after fuse 46 serves to ignite propellant 48, ball retaining piston 36 is driven upward by the force of propellant 48 to the position depicted in FIG. 2. At this point, steel balls 34 are free from the confines of annular groove 38 and lower portion 28 of contact subassembly 12 is no longer coupled to bleed-off subassembly 30 by the action of steel balls 34. While the cutting action is taking place apparatus 10 is held in place by the action of slips 66 (see FIG. 1C), and until such time as pressure within apparatus 10 diminishes to the point where slips 66 retract, the tool is retained in place within the well bore.

After the cutting action has been completed apparatus 10 may be withdrawn; however, it is known in prior art chemical cutting tools that the tiny passages which form discharge passage 102 may become clogged by debris, drilling mud or refuse remaining in the borehole after the chemical cutting action has occurred. Thus, as apparatus 10 is withdrawn from a deep position within a borehole, the internal pressure within apparatus 10 may at some point be substantially greater than the diminishing hydrostatic pressure encountered within the borehole outside apparatus 10. At this point, it is likely that slips 66 may again erect, anchoring apparatus 10 within the well bore and prohibiting its withdrawal to the surface.

Referring now particularly to FIG. 3, the manner in which this pressure within apparatus 10 may be selectively bled off is illustrated. As apparatus 10 is anchored at some point during withdrawal the operator on the surface may continue to exert upward pressure on apparatus 10, shearing shear screws 32. Because steel balls 34 are no longer prohibiting longitudinal movement between the lower portion 28 of contact subassembly 12 and bleed-off subassembly 30, lower portion 28 will slide upward on bleed-off assembly 30 to the point where limit stop 108 engages beveled surface 106. At this point, secondary discharge passage 104, which is coupled into the central longitudinal passage of apparatus 10, is exposed to the ambient pressure within the well bore beneath the lip through which shear screw 32 is mounted. Thus, internal pressure within apparatus 10 may be selectively released by shearing shear screws 32 and telescoping two sections of apparatus 10. Those ordinarily skilled in the art will appreciate that the action of steel balls 34 serve to prevent the accidental opening of secondary discharge passage 104 at any time prior to the ignition and operation of chemical cutting apparatus 10. Thus, the operator can be assured that apparatus 10 may be inserted into a well bore and lowered to the desired depth and operated without the fear that the chemical cutting fluid will be directed at a surface other than the surface immediately adjacent to discharge passage 102.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An apparatus for cutting inside a well bore comprising:

a tubular casing adapted to be inserted into a well bore;

a longitudinal passage disposed within said tubular casing;

a chamber disposed within said tubular casing for containing a chemical cutting fluid;

a closure member disposed between said chamber and said longitudinal passage, said closure member adapted to open in response to fluid pressure within said chamber;

means for generating fluid pressure within said chamber;

discharge passage means coupled to said longitudinal passage for coupling said chemical cutting fluid into said well bore; and means for selectively releasing fluid pressure from within said longitudinal passage.

2. The apparatus for cutting inside a well bore according to claim 1 wherein said tubular casing includes means for coupling said tubular casing to a cable suitable for lowering said tubular casing into said well bore.

3. The apparatus for cutting inside a well bore according to claim 1 wherein said means for generating fluid pressure within said chamber comprises an explosive charge and means for igniting said explosive charge.

4. The apparatus for cutting inside a well bore according to claim 3 wherein said means for selectively releasing fluid pressure from within said longitudinal passage further includes means for preventing release of fluid pressure from within said longitudinal passage prior to ignition of said explosive charge.

5. An apparatus for cutting inside a well bore comprising:

a tubular casing adapted to be inserted into a well bore;

a longitudinal passage disposed within said tubular casing;

a chamber disposed within said tubular casing for containing a chemical cutting fluid;

a closure member disposed between said chamber and said longitudinal passage, said closure member adapted to open in response to fluid pressure within said chamber;

means for generating fluid pressure within said chamber;

discharge passage means coupled to said longitudinal passage for coupling said chemical cutting fluid into said well bore;

means for rigidly anchoring said tubular casing within said well bore in response to fluid pressure within said longitudinal passage; and means for selectively releasing fluid pressure from within said longitudinal passage.

6. The apparatus for cutting inside a well bore according to claim 5 wherein said tubular casing includes means for coupling said tubular casing to a cable suitable for lowering said tubular casing into said well bore.

7. The apparatus for cutting inside a well bore according to claim 5 wherein said means for generating fluid pressure within said chamber comprises an explosive charge and means for igniting said explosive charge.

8. The apparatus for cutting inside a well bore according to claim 7 wherein said means for selectively releasing fluid pressure from within said longitudinal passage further includes means for preventing release of fluid pressure from within said longitudinal passage prior to ignition of said explosive charge.

9. The apparatus for cutting inside a well bore according to claim 5 wherein said means for rigidly anchoring said tubular casing within said well bore in response to fluid pressure within said longitudinal passage comprises a plurality of pressure operated slips disposed around the periphery of said tubular casing, said plurality of pressure operated slips being responsive to pressure within said longitudinal passage to extend outward from said tubular casing.

10. An apparatus for cutting inside a well bore comprising:

a telescoping tubular assembly adapted to be inserted into a well bore, said telescoping tubular assembly including a first tubular section and a second tubular section, said first tubular section being longitudinally movable with respect to said second tubular section from a first position to a second position;

a longitudinal passage disposed within said telescoping tubular assembly;

a chamber disposed within said telescoping tubular assembly for containing a chemical cutting fluid;

a closure member disposed between said chamber and said longitudinal passage, said closure member adapted to open in response to fluid pressure within said chamber;

means for generating fluid pressure within said chamber;

discharge passage means coupled to said longitudinal passage for coupling said chemical cutting fluid into said well bore; and a second discharge passage for selectively coupling said longitudinal passage with said well bore in response to said first tubular section moving from said first position to said second position.

11. The apparatus for cutting inside a well bore according to claim 10 wherein said telescoping tubular assembly includes means for coupling said telescoping tubular assembly to a cable suitable for lowering said telescoping tubular assembly into said well bore.

12. The apparatus for cutting inside a well bore according to claim 10 wherein said means for generating fluid pressure within said chamber comprises an explosive charge and means for igniting said explosive charge.

13. The apparatus for cutting inside a well bore according to claim 12 further including means for preventing said first tubular section from moving from said first position to said second position prior to ignition of said explosive charge.

14. The apparatus for cutting inside a well bore according to claim 12 further including means for rigidly anchoring said tubular casing within said well bore in response to fluid pressure within said longitudinal passage.

15. The apparatus for cutting inside a well bore according to claim 10 wherein said second discharge passage for selectively coupling said longitudinal passage with said well bore comprises a passage through said second tubular section which is sealed while said first tubular section is disposed in said first position and which communicates with said well bore when said first tubular section is disposed in said second position.

* * * * *